US008715016B2

(12) United States Patent
DeBock et al.

(10) Patent No.: US 8,715,016 B2
(45) Date of Patent: May 6, 2014

(54) ELECTRICAL CONNECTOR WITH SIGNAL AND POWER CONNECTIONS

(75) Inventors: Kimberly Anne DeBock, Hummelstown, PA (US); Robert Charles Flaig, Lancaster, PA (US); Graham Harry Smith, Jr., Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 51 days.

(21) Appl. No.: 13/112,796

(22) Filed: May 20, 2011

(65) Prior Publication Data

US 2011/0294342 A1 Dec. 1, 2011

Related U.S. Application Data

(60) Provisional application No. 61/348,180, filed on May 25, 2010.

(51) Int. Cl.
*H01R 13/24* (2006.01)

(52) U.S. Cl.
USPC ..... 439/701; 439/752

(58) Field of Classification Search
USPC ..... 439/607.01, 607.05, 607.08, 607.23, 439/607.25, 607.27, 701, 752
See application file for complete search history.

(56) References Cited

U.S. PATENT DOCUMENTS

| | | | | |
|---|---|---|---|---|
| 3,354,454 | A * | 11/1967 | Rueger | 340/815.49 |
| 3,745,512 | A * | 7/1973 | Johnson et al. | 439/599 |
| 4,158,473 | A | 6/1979 | Shearer | |
| 5,194,020 | A * | 3/1993 | Voltz | 439/579 |
| 5,708,705 | A * | 1/1998 | Yamashita et al. | 379/435 |
| 6,776,652 | B2 * | 8/2004 | Nakura et al. | 439/540.1 |
| 6,910,911 | B2 * | 6/2005 | Mellott et al. | 439/358 |
| 7,402,078 | B2 * | 7/2008 | Wan et al. | 439/607.01 |
| 7,740,501 | B2 * | 6/2010 | Ballard et al. | 439/578 |
| 8,079,878 | B2 * | 12/2011 | Huang | 439/660 |
| 8,267,723 | B2 * | 9/2012 | Hering et al. | 439/660 |
| 2002/0182941 | A1 | 12/2002 | Okabe et al. | |
| 2009/0011639 | A1 * | 1/2009 | Ballard et al. | 439/607 |

FOREIGN PATENT DOCUMENTS

| | | | |
|---|---|---|---|
| EP | 1 126 557 | A2 | 8/2001 |
| GB | 2 274 559 | A | 7/1994 |
| WO | 2008149236 | A2 | 12/2008 |

OTHER PUBLICATIONS

European Search Report, Mail Date May 4, 2013, EP 11 16 7351, Application No. 11167351.3-1808/2390960.

* cited by examiner

*Primary Examiner* — Neil Abrams
*Assistant Examiner* — Phuong T Nguyen

(57) ABSTRACT

An electrical connector includes a connector housing having at least one contact cavity and an interchange port. A power contact is held by the connector housing within the contact cavity. The power contact is configured to conduct electrical power. An interchangeable signal module is separably mounted to the connector housing such that at least a portion of the signal module is held within the interchange port of the connector housing. The signal module includes an insulator holding a signal contact that is configured to conduct electrical data signals.

22 Claims, 10 Drawing Sheets

ELECTRICAL CONNECTOR WITH SIGNAL AND POWER CONNECTIONS

BACKGROUND OF THE INVENTION

The subject matter described and/or illustrated herein relates generally to electrical connectors, and more particularly, to electrical connectors that include both signal contacts and power contacts.

Electrical connectors are commonly used to interconnect a wide variety of electrical components. Some known electrical connectors provide both signal paths and electrical power paths between the electrical components. More particularly, some electrical connectors include a single housing that holds one or more signal contacts and one or more power contacts. The signal contacts electrically connect to corresponding signal contacts or signal conductors of the electrical components to provide a signal path between the components. Similarly, the power contacts electrically connect to corresponding power contacts or power conductors of the electrical components to provide an electrical power path between the components.

Presently, the demand for higher performance electrical systems continues to increase. For example, electrical connectors are being tasked with being capable of accommodating ever increasing signal data rates between the electrical components of an electrical system. Examples of such an increased signal data rate include Gigabit Ethernet (GbE) and 10 GbE. But, the signal contacts of at least some existing connectors that provide both signal and power paths may be incapable of handling such increased signal data rates. As the power contacts of such electrical connectors are still adequate, the connectors are not replaced. Rather, the existing connector is still used to provide the power connections, while a separate second connector is added to the system to handle the higher speed signal connections. But, the second connector undesirably adds weight and an extra component to the system.

BRIEF DESCRIPTION OF THE INVENTION

In one embodiment, an electrical connector includes a connector housing having at least one contact cavity and an interchange port. A power contact is held by the connector housing within the contact cavity. The power contact is configured to conduct electrical power. An interchangeable signal module is separably mounted to the connector housing such that at least a portion of the signal module is held within the interchange port of the connector housing. The signal module includes an insulator holding a signal contact that is configured to conduct electrical data signals.

In another embodiment, an electrical connector assembly includes a pin connector having a pin connector housing. A power pin contact is held by the pin connector housing. The pin connector also includes a signal pin contact. The power pin contact is configured to conduct electrical power. The signal pin contact is configured to conduct electrical data signals. The pin connector includes a first interchange port extending within the pin connector housing and an interchangeable first signal module separably mounted to the pin connector housing such that at least a portion of the first signal module is held within the first interchange port. The first signal module includes a first insulator that holds the signal pin contact. The assembly also includes a socket connector configured to mate with the pin connector. The socket connector includes a socket connector housing. A power socket contact is held by the socket connector housing. The socket connector also includes a signal socket contact. The power socket contact is configured to conduct electrical power. The signal socket contact is configured to conduct electrical data signals. The socket connector includes a second interchange port extending within the socket connector housing and an interchangeable second signal module separably mounted to the socket connector housing such that at least a portion of the second signal module is held within the second interchange port. The second signal module includes a second insulator that holds the signal socket contact.

DETAILED DESCRIPTION OF THE INVENTION

Figure 1:
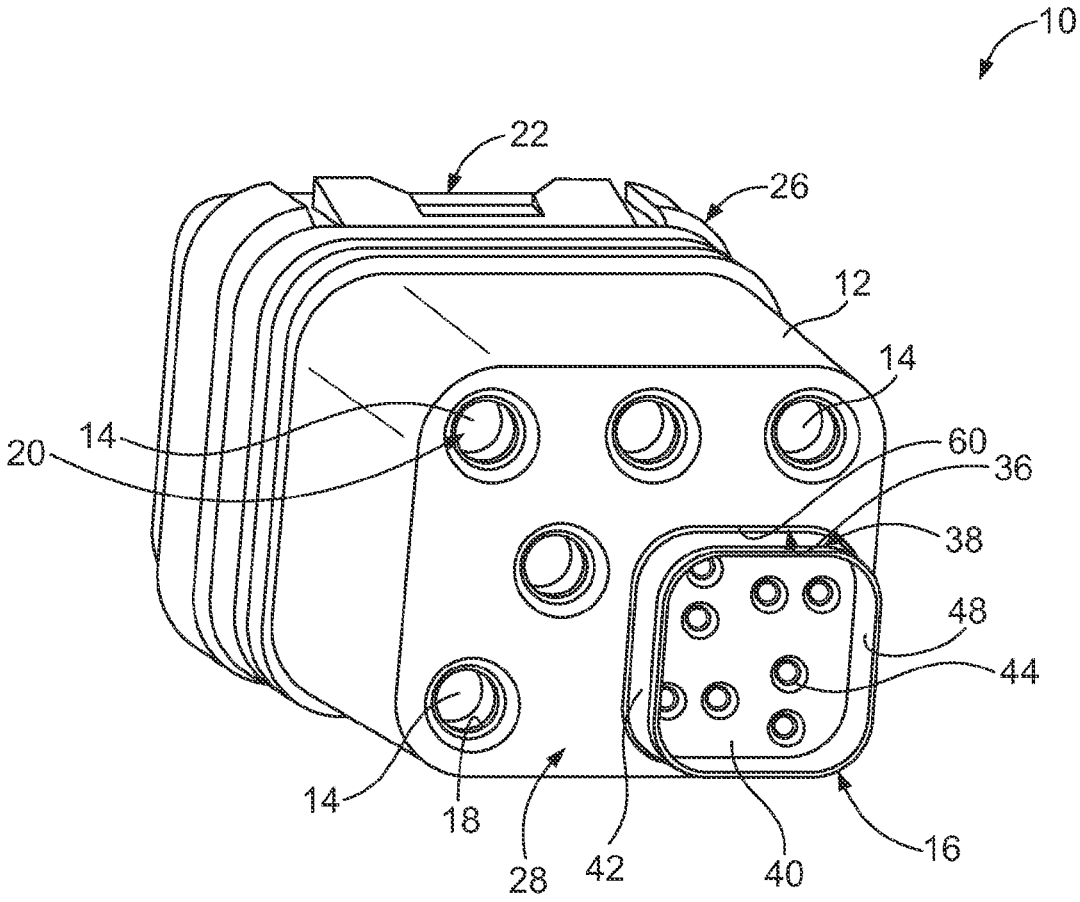
FIG. 1 is a front perspective view of an exemplary embodiment of an electrical connector.
Figure 2:
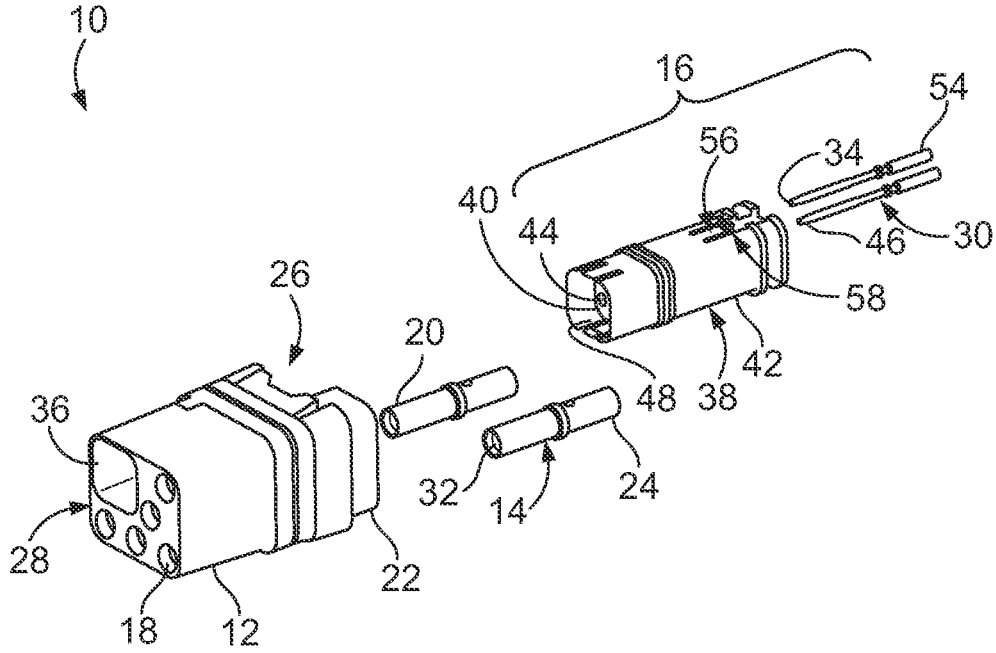
FIG. 2 is an exploded perspective view of the electrical connector shown in FIG. 1.

FIG. 1 is a perspective view of an exemplary embodiment of an electrical connector 10. FIG. 2 is an exploded perspective view of the electrical connector 10. Referring now to FIGS. 1 and 2, the connector 10 includes a connector housing 12, one or more power contacts 14 held by the connector housing 12, and an interchangeable signal module 16 configured to be separably mounted to the connector housing 12. As will be described below, the signal module 16 is configured to conduct electrical data signals. For example, the signal module 16 includes one or more signal contacts 30 that are configured to conduct electrical data signals. The connector housing 12 includes one or more contact cavities 18 for holding the power contacts 14, which are configured to conduct electrical power and include mating ends 20. An optional grommet 22 extends over ends 24 (not visible in FIG. 1) of the power contacts 14 at a rear end 26 of the connector housing 12. Specifically, the grommet 22 includes a plurality of contact cavities (not shown) that each receives the end 24 of a corresponding power contact 14 therein.

Referring now solely to FIG. 2, in some embodiments, the connector 10 is configured to be mounted on a printed circuit board (PCB; not shown) or other electrical component. Alternatively, the connector 10 terminates the end of a cable (not shown). The exemplary embodiment of the connector 10 mates with a complementary connector 110 (FIG. 4) at a mating interface 28 of the connector 10. The electrical connector 110 includes an interchangeable signal module 116 (FIG. 4) that mates with the signal module 16 of the connector 10. In the exemplary embodiment, the connector 10 is a socket connector wherein the power contacts 14 and signal contacts 30 of the connector 10 include respective receptacles 32 and 34 that receive pins (e.g., the pins 132 and 134 of power and signal contacts 114 and 130, respectively, of the electrical connector 110) of the mating connector or the electrical component with which the connector 10 mates. Alternatively, one or more of the power contacts 14 and/or one or more of the signal contacts 30 of the connector 10 includes a pin that is configured to be received within a receptacle of the corresponding contact of the mating connector or the electrical component with which the connector 10 mates. In some embodiments, the connector 10 is an EN4165 monoblock module connector.

Although the connector housing 12 includes five contact cavities 18 and the connector 10 includes five power contacts 14, the connector housing 12 may include any number of contact cavities 18 and the connector 10 may include any number of the power contacts 14. The contact cavities 18 and the power contacts 14 may be arranged in any other pattern than is shown. Each of the power contacts 14 may be any type of power contact having any size, such as, but not limited to, a size 16 power contact, a size 20 power contact, and/or the like. The connector 10 may be configured to conduct any amount of electrical power, such as, but not limited to, approximately 7.5 Amps, approximately 15 Amps, and/or the like.

The connector housing 12 also includes an interchange port 36 for receiving the signal module 16. The signal module 16 includes one or more of the signal contacts 30, which as described above are configured to conduct electrical data signals. In other words, the signal contacts 30 provide a signal path through the signal module 16, and thereby through the connector 10. The signal contacts 30 are held by an insulator 40 of the signal module 16.

Figure 3:
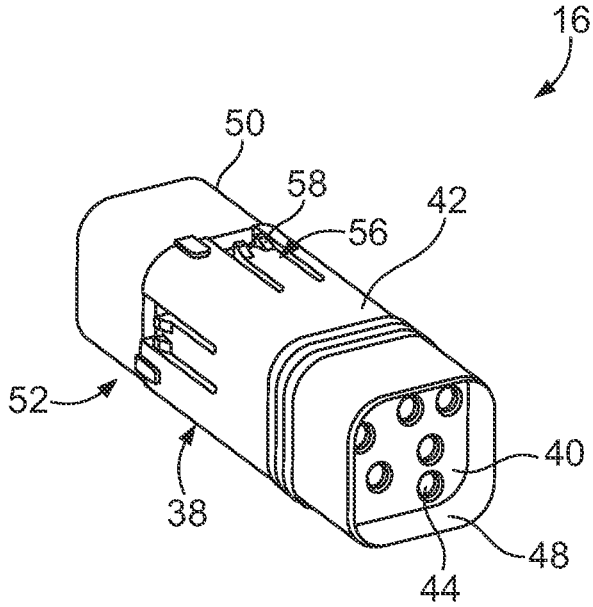
FIG. 3 is a perspective view of an exemplary embodiment of a signal module of the electrical connector shown in FIGS. 1 and 2.

FIG. 3 is a perspective view of an exemplary embodiment of the signal module 16. Referring now to FIGS. 1-3, the signal module 16 includes the insulator 40 and an optional shell 42. In the exemplary embodiment, the insulator 40 includes one or more contact openings 44 that receive mating ends 46 (FIG. 2) of the signal contacts 30 therein. The contact openings 44 are best seen in FIGS. 1 and 3, although the signal contacts 30 are not visible in FIGS. 1 and 3. In the exemplary embodiment, the signal contacts 30 are held by the insulator 40 by being press-fit within the contact openings 44. But, the signal contacts 30 may be additionally or alternatively held by the insulator 40 using any other suitable method, structure, means, configuration, connection type, and/or the like, such as, but not limited to, using a snap-fit connection, a latch, a fastener, and/or the like. The insulator 40 forms a shroud that extends around each of the signal contacts 30. The shell 42 includes a receptacle 48 that receives the insulator 40 therein such that the shell 42 extends around the insulator 40. The shell 42 may be formed from insulating materials, electrically conductive materials, or a combination thereof. For example, in some embodiments the shell 42 is formed from an insulating material that is coated with an electrically conductive material. Optionally, when the shell 42 includes or is entirely formed from an electrically conductive material, the shell 42 may provide an electrically conductive shield that at least partially surrounds the signal contacts 30, for example to shield the signal contacts 30 from the power contacts 14. In addition or alternative to the shell 42, other shielding components may be provided. In an alternative embodiment, the shell 42 is not a component of the signal module 16, but rather is a separate component from the signal module 16 that is held by the connector housing 12 such that the shell 42 is positioned proximate or within the interchange port 36. Optionally the shell 42 is formed by plating the insulator 40. The shell 42 may be referred to herein as an "electrically conductive shield".

As can be seen in FIG. 3, the signal module 16 includes an optional grommet 50 at a rear end 52 of the insulator 40. The grommet 50 extends over ends 54 (FIG. 2) of the signal contacts 30 (FIG. 2) that are opposite the mating ends 46 (FIG. 2) of the signal contacts 30. Specifically, the grommet 50 includes a plurality of contact cavities (not shown) that receive the ends 54 of corresponding signal contacts 30 therein.

Referring now to FIGS. 1 and 2, as briefly described above, the signal module 16 is configured to be separably mounted to the connector housing 12. When mounted to the connector housing 12, the connector 10 provides both signal and power paths via the signal module 16 and the power contacts 14, respectively. As used herein, the term "separably mounted" is intended to mean that the signal module 16 is capable of being selectively mounted to, and optionally selectively dismounted from, the connector housing 12 without damaging the signal module 16 and/or the connector housing 12. In other words, the term "separably mounted" is intended to mean that the signal module 16 is capable of received into, and optionally removed from, the interchange port 36 without damaging the signal module 16 and/or the connector housing 12. The signal module 16 is interchangeable with other signal modules. For example, a variety of different signal modules may be held within the interchange port 36 in place of the signal module 16. In some embodiments, the signal module 16 may be removed from the connector housing 12 and replaced with a different signal module. The different signal modules that are used in place of, or replace, the signal module 16 may have different operational characteristics, features, parameters, electrical performance, and/or the like than the signal module 16. For example, the different signal modules that are used in place of, or replace, the signal module 16 may have a different number of signal contacts 30, different types of signal contacts 30, differently sized signal contacts 30, a different pattern of signal contacts 30, and/or the like than the signal module 16. Additionally or alternatively, and for example, the different signal modules that are used in place of, or replace, the signal module 16 may be configured conduct a different data rate, may have different impedance, and/or the like than the signal module 16. Accordingly, it should be appreciated that the signal modules described and/or illustrated herein are modular components that may be selectively used with the connectors described and/or illustrated herein or replaced by a different signal module within the connectors described and/or illustrated herein.

Referring now FIGS. 2 and 3, in the exemplary embodiment, the signal module 16 is separably mounted to the connector housing 12 (not shown in FIG. 3) using a snap-fit connection. Specifically, the signal module 16 is received within the interchange port 36 (not shown in FIG. 3) of the connector housing 12 with a snap-fit connection. In the exemplary embodiment, the snap-fit connection between the signal module 16 and the connector housing 12 is provided by one or more resiliently deflectable latch arms 56 on the shell 42 that cooperate with shoulders (not shown) of the connector housing 12 that extend within the interchange port 36. When the signal module 16 is inserted into the interchange port 36, each latch arm 56 engages a feature (such as, but not limited to, a ramp and/or the like) of the connector housing 12 that deflects a hook end 58 of the latch arm 56, against the bias thereof, away (e.g., radially inward) from the natural resting position shown in FIGS. 2 and 3. Once the latch arm 56 has deflected sufficiently such that the hook end 58 of the latch arm 56 clears the shoulder, the resilience of the latch arm 56 moves the hook end 58 back to (or at least toward) the natural resting position such that the hook end 58 extends over the shoulder in a hook-like fashion. To remove the signal module 16 from the interchange port 36 and thereby dismount the signal module 16 from the connector housing 12, the hook end 58 of the latch arm 56 can be deflected against the bias (e.g., using a tool, a person's finger, and/or the like) in a direction away from the shoulder (e.g., radially inwardly) such that the latch arm 56 clears the shoulder. The signal module 16 can then be removed from the interchange port 36.

In addition or alternatively to the exemplary embodiment of the snap-fit connection described above, the snap-fit connection between the signal module 16 and the connector housing 12 may be provided by any other structure, means, and/or the like. Moreover, in addition or alternatively to the snap-fit connection, the signal module 16 may be separably mounted to the connector housing 12 using any other type of connection, such as, but not limited to, a press-fit connection, using a latch, using a clip, using a threaded fastener, using a non-threaded fastener, and/or the like. In addition or alternatively to being provided on and/or as a component of the shell 42, any mounting members, structures, features, means, and/or the like (e.g., the latch arms 56 and the cooperating ramps and shoulders) used to separably mount the signal module 16 to the connector housing 12 may be provided on and/or as a component of the insulator 40 and/or the connector housing 12, whether such mounting members, structures, features, means, and/or the like operate with a snap-fit and/or other type of connection. For example, in some alternative embodiments wherein the shell 42 is not included, the mounting members used to separably mount the signal module 16 to the connector housing 12 may be provided on and/or as a component of the insulator 40.

Referring again to FIG. 1, when the signal module 16 is held by connector housing 12 within the interchange port 36, a slot 60 is optionally defined within the interchange port 36 between the signal module 16 and the connector housing 12. Specifically, the slot 60 is defined between an exterior surface of the shell 42 and an interior surface of the connector housing 12 that defines the interchange port 36. As will be described below, the slot 60 receives a shell 142 (FIG. 4) of the signal module 116 (FIG. 4) of the electrical connector 110 (FIG. 4) therein when the connectors 10 and 110 are mated together. Accordingly, in the exemplary embodiment, the shell 142 of the signal module 116 of the electrical connector 110 is received between the shell 42 and the connector housing 12 of the electrical connector 10 when the connectors 10 and 110 are mated together. Alternatively, the slot 60 is defined between the insulator 40 and the shell 42 of the signal module 16 of the electrical connector 10 such that the shell 142 of the signal module 116 of the electrical connector 110 is received between the insulator 40 and the shell 42 of the signal module 16 when the connectors 10 and 110 are mated together. In another alternative embodiment, the electrical connector 10 does not include the slot 60, for example because the signal module 116 does not include the shell 142, because the signal contacts 130 of the signal module 116 extend past the shell 142, because the length, dimension, and/or the like of one or more components of the signal modules 16 and/or 116 are selected to enable mating of the connectors 10 and 110 without the slot 60, and/or the like. It should be understood that the shell 142 of the signal module 116 may receive the shell 42 at least partially therein, as in the exemplary embodiment, that the shell 42 may receive the shell 142 at least partially therein, or that neither shell 42 or 142 receives the other therein when the connectors 10 and 110 are mated together. The slot 60 may be referred to herein as a "shield slot".

Referring now to FIGS. 1 and 2, although shown as including only a single interchange port 36 for holding a single signal module 16, the connector 10 may include any number of interchange ports 36 for holding any number of signal modules 16. In other words, the connector 10 may include any number of interchange ports 36 overall and any number of signal modules 16 overall, and each interchange port 36 may hold any number of the signal modules 16. Although shown as having the overall shape of a parallelepiped, the signal module 16 may additionally or alternatively include any other shape. The interchange port 36 is shown herein as having a parallelepiped shape that is complementary with the shape of the signal module 16. But, the interchange port 36 may include any other shape than is shown for receiving a signal module having any shape, whether or not such shape is complementary, similar, and/or the substantially the same as shape of the signal module received therein. Moreover, the interchange port 36 may include any other location within the connector housing 12 than is shown. In some embodiments, the location of the interchange port 36 may be selected to accommodate mounting the connector 10 on a PCB, to accommodate terminating the connector 10 to the end of a cable, and/or to accommodate a pattern of the power contacts 14.

Although the insulator 40 includes eight contact openings 44, the insulator 40 may include any number of contact openings 44 for receiving any number of signal contacts 30. Moreover, although eight are shown, the signal module 16 may include any number of the signal contacts 30. The contact openings 44 and the signal contacts 30 may be arranged in any other pattern than is shown. Each of the signal contacts 30 may be any type of signal contact having any size, such as, but not limited to, a size 24 signal contact, a size 22 signal contact, and/or the like. The signal module 16 may be configured to conduct electrical data signals at any rate, standard, and/or the like, such as, but not limited to, 10 Gigabit Ethernet (GbE), less than 10 GbE, greater than 10 GbE, and/or the like. In some embodiments, the signal module 16 is a high-speed connector that conducts electrical data signals at least 1 GbE.

Figure 4:
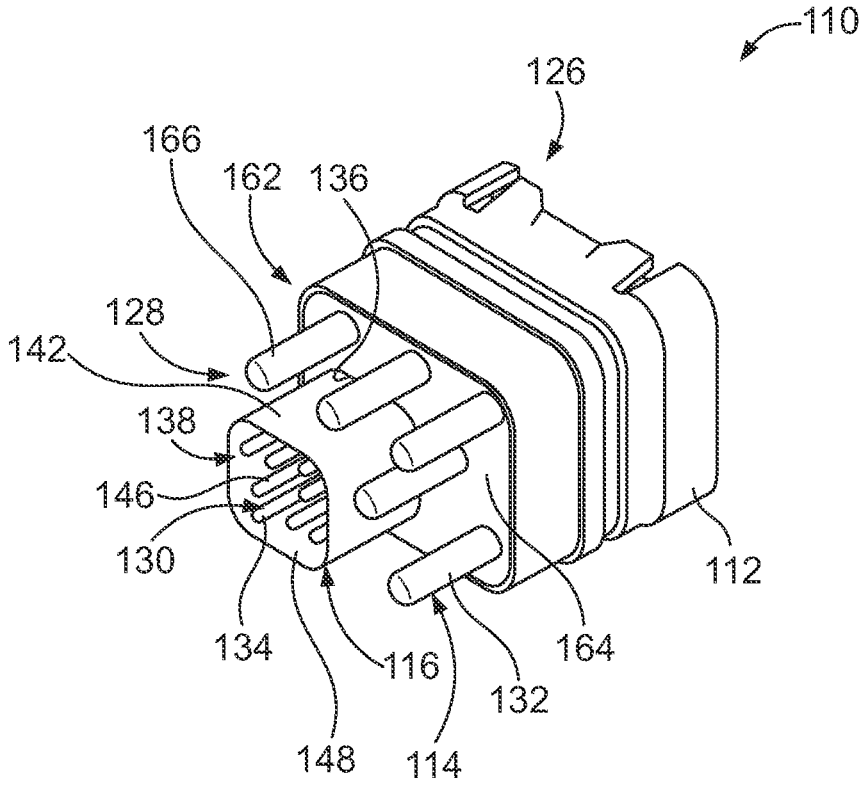
FIG. 4 is a perspective view of an exemplary embodiment of an electrical connector that is configured to mate with the electrical connector shown in FIGS. 1 and 2.

FIG. 4 is a perspective view of an exemplary embodiment of the electrical connector 110 that is configured to mate with the electrical connector 10 (FIGS. 1-3). A combination of the connectors 10 and 110 may be referred to herein as an "electrical connector assembly". The connector 110 includes a connector housing 112, one or more of the power contacts 114 held by the connector housing 112, and an optional interchangeable signal module 116 configured to be separably mounted to the connector housing 112. The signal module 116 includes one or more of the signal contacts 130, which are configured to conduct electrical data signals. Optionally, a grommet (not shown) extends over ends (not shown) of the power contacts 114 at a rear end 126 of the connector housing 112.

In some embodiments, the connector 110 is configured to be mounted on a PCB (not shown) or other electrical component. Alternatively, the connector 110 terminates the end of a cable (not shown). As described above, in the exemplary embodiment, the connector 110 mates with the complementary connector 10 (FIGS. 1-3) at a mating interface 128 of the connector 110. The connector 110 optionally includes an interfacial seal (not shown) that seals the mating interface 128. Although in the exemplary embodiment the electrical connector 10 includes an interchangeable signal module 16 (FIGS. 1-3) that mates with the signal module 116 of the connector 110, the connector 110 may alternatively mate with a connector that does not include an interchangeable signal module. In the exemplary embodiment, the power contacts 114 and signal contacts 130 of the connector 110 include respective pins 132 and 134 that are received within the receptacles 32 and 34 (FIG. 2), respectively, of the respective power and signal contacts 14 and 30 (FIG. 2) of the electrical connector 10. Alternatively, one or more of the power contacts 114 and/or one or more of the signal contacts 130 of the connector 110 includes a receptacle that is configured to receive a pin of the corresponding contact of the connector 10 or the electrical component with which the connector 110 mates. In some embodiments, the connector 110 is an EN4165 monoblock module connector.

The connector housing 112 extends from the rear end 126 to a front end 162 that includes a front face 164. Mating ends 166 of the power contacts 114 extend outwardly from the front face 164 of the connector housing 112 for mating with the power contacts 14 of the connector 10. Although the connector 110 includes five power contacts 114, the connector 110 may include any number of the power contacts 114. The power contacts 114 may be arranged in any other pattern than is shown. Each of the power contacts 114 may be any type of power contact having any size, such as, but not limited to, a size 16 power contact, a size 20 power contact, and/or the like. The connector 10 may be configured to conduct any amount of electrical power, such as, but not limited to, approximately 7.5 Amps, approximately 15 Amps, and/or the like.

The signal module 116 includes the signal contacts 130 and an insulator (not shown) that holds the signal contacts 130. The signal module 116 includes the insulator and an optional shell 142. The signal contacts 130 are held by the insulator. The shell 142 includes a receptacle 148 that receives the insulator therein such that the shell 142 extends around the insulator. Mating ends 146 of the signal contacts 130 extend outwardly from the insulator within the receptacle 148 for mating with the signal contacts 30. The shell 142 forms a shroud that extends around the mating ends 146 of the signal contacts 130. The shell 142 may be formed from insulating materials, electrically conductive materials, or a combination thereof. For example, in some embodiments the shell 142 is formed from an insulating material that is coated with an electrically conductive material. Optionally, when the shell 142 includes or is entirely formed from an electrically conductive material, the shell 142 may provide an electrically conductive shield that at least partially surrounds the signal contacts 130, for example to shield the signal contacts 130 from the power contacts 114. In addition or alternative to the shell 142, other shielding components may be provided. In an alternative embodiment, the shell 142 is not a component of the signal module 116, but rather is a separate component from the signal module 116 that is held by the connector housing 112 such that the shell 142 is positioned proximate or within the interchange port 136. Optionally the shell 142 is formed by plating the insulator. The shell 142 may be referred to herein as an "electrically conductive shield".

The connector housing 112 also includes an interchange port 136 for receiving the signal module 116. The signal module 116 is configured to be separably mounted to the connector housing 112. When mounted to the connector housing 112, the connector 110 provides both signal and power paths via the signal module 116 and the power contacts 114, respectively. The signal module 116 is interchangeable with other signal modules. As described above, the signal module 116 is optional. In embodiments wherein the connector 110 does not include the signal module, the signal contacts 130 are held by the connector housing 112.

In the exemplary embodiment, the signal module 116 is separably mounted to the connector housing 112 using a snap-fit connection. In addition or alternatively to the snap-fit connection, the signal module 116 may be separably mounted to the connector housing 112 using any other type of connection, such as, but not limited to, a press-fit connection, using a latch, using a clip, using a threaded fastener, using a non-threaded fastener, and/or the like.

The connector 110 may include any number of interchange ports 136 overall and any number of signal modules 116 overall, and each interchange port 136 may hold any number of the signal modules 116. The signal module 116 may additionally or alternatively include any other shape than is shown herein. Moreover, the interchange port 136 may include any other shape than is shown for receiving a signal module having any shape, whether or not such shape is complementary, similar, and/or the substantially the same as shape of the signal module received therein. Moreover, the interchange port 136 may include any other location within the connector housing 112 than is shown. In some embodiments, the location of the interchange port 136 may be selected to accommodate mounting the connector 110 on a PCB, to accommodate terminating the connector 110 to the end of a cable, and/or to accommodate a pattern of the power contacts 114.

Although eight are shown, the signal module 116 may include any number of the signal contacts 130. The signal contacts 130 may be arranged in any other pattern than is shown. Each of the signal contacts 130 may be any type of signal contact having any size, such as, but not limited to, a size 24 signal contact, a size 22 signal contact, and/or the like. The signal module 116 may be configured to conduct electrical data signals at any rate, standard, and/or the like, such as, but not limited to, 10 Gigabit Ethernet (GbE), less than 10 GbE, greater than 10 GbE, and/or the like. In some embodiments, the signal module 116 is a high-speed connector that conducts electrical data signals at least 1 GbE.

In the exemplary embodiment of the signal modules 16 and 116, the shells 42 and 142 extend completely around at least the mating ends 46 (FIG. 2) and 146 (FIG. 4), respectively, of the respective group of signal contacts 30 and 130. In other words, the shells 42 and 142 are each defined by continuous closed shapes that extend around an entirety of the circumference of the respective group of mating ends 46 and 146. However, in some alternative embodiments, the shell 42 and/or the shell 142 extends only partially around the group of respective mating ends 46 and 146. In other words, in some alternative embodiments, the shell 42 and/or the shell 142 is defined by an discontinuous open shape that extends around only a portion of the circumference of the respective group of mating ends 46 and 146.

Figure 5:
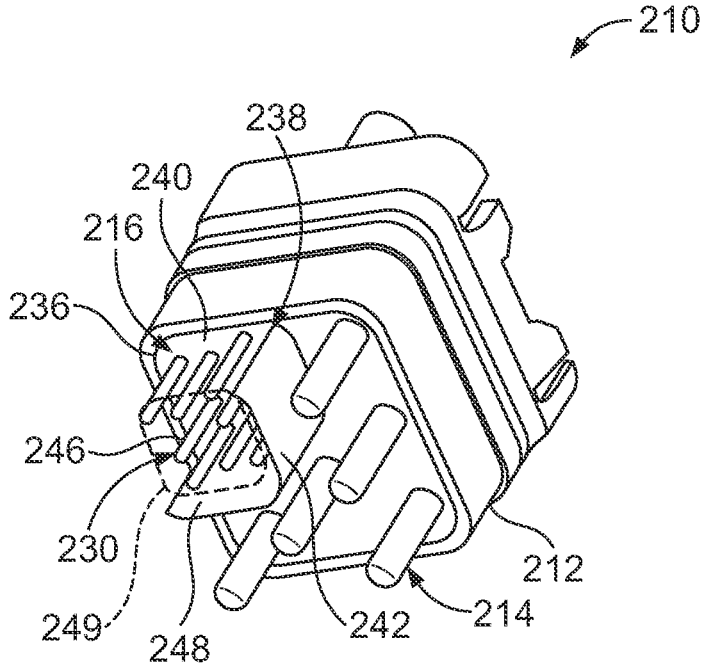
FIG. 5 is a perspective view of an exemplary alternative embodiment of an electrical connector.

For example, FIG. 5 is a perspective view of an exemplary alternative embodiment of an electrical connector 210. The connector 210 includes a connector housing 212, one or more power contacts 214 held by the connector housing 212, and an interchangeable signal module 216 configured to be separably mounted to the connector housing 212. The connector housing 212 includes an interchange port 236 that receives the signal module 216 therein. The signal module 216 includes an insulator 240 and an optional shell 242. The insulator 240 holds signal contacts 230 that are configured to conduct electrical data signals. The shell 242 includes a receptacle 248 that receives the insulator 240 therein. Mating ends 246 of the signal contacts 230 extend outwardly from the insulator 240.

The shell 242 forms a shroud that extends around the mating ends 246 of the signal contacts 230. As can be seen in FIG. 5, the shell 242 extends only partially around the group of mating ends 246 of the signal contacts 230. In other words, the shell 242 is defined by a discontinuous open shape that extends around only a portion of the circumference 249 of the group of mating ends 246. In the exemplary embodiment, the shell 242 extends around approximately half of the circumference of the group of mating ends 246. But, the shell 242 may extend around any partial amount of the circumference of the group of mating ends 246. Because the shell 242 extends only partially around the group of mating ends 246, additional space for a greater number, density, and/or the like of the contacts 214 and/or 230 may be provided. In an alternative embodiment, the shell 242 is not a component of the signal module 216, but rather is a separate component from the signal module 216 that is held by the connector housing 212 such that the shell 242 is positioned proximate or within the interchange port 236.

The shell 242 may be formed from insulating materials, electrically conductive materials, or a combination thereof. For example, in some embodiments the shell 242 is formed from an insulating material that is coated with an electrically conductive material. Optionally, when the shell 242 includes or is entirely formed from an electrically conductive material, the shell 242 may provide an electrically conductive shield that at least partially surrounds the signal contacts 230, for example to shield the signal contacts 230 from the power contacts 214. In addition or alternative to the shell 242, other shielding components may be provided. Optionally the shell 242 is formed by plating the insulator 240. The shell 242 may be referred to herein as an "electrically conductive shield".

Figure 6:
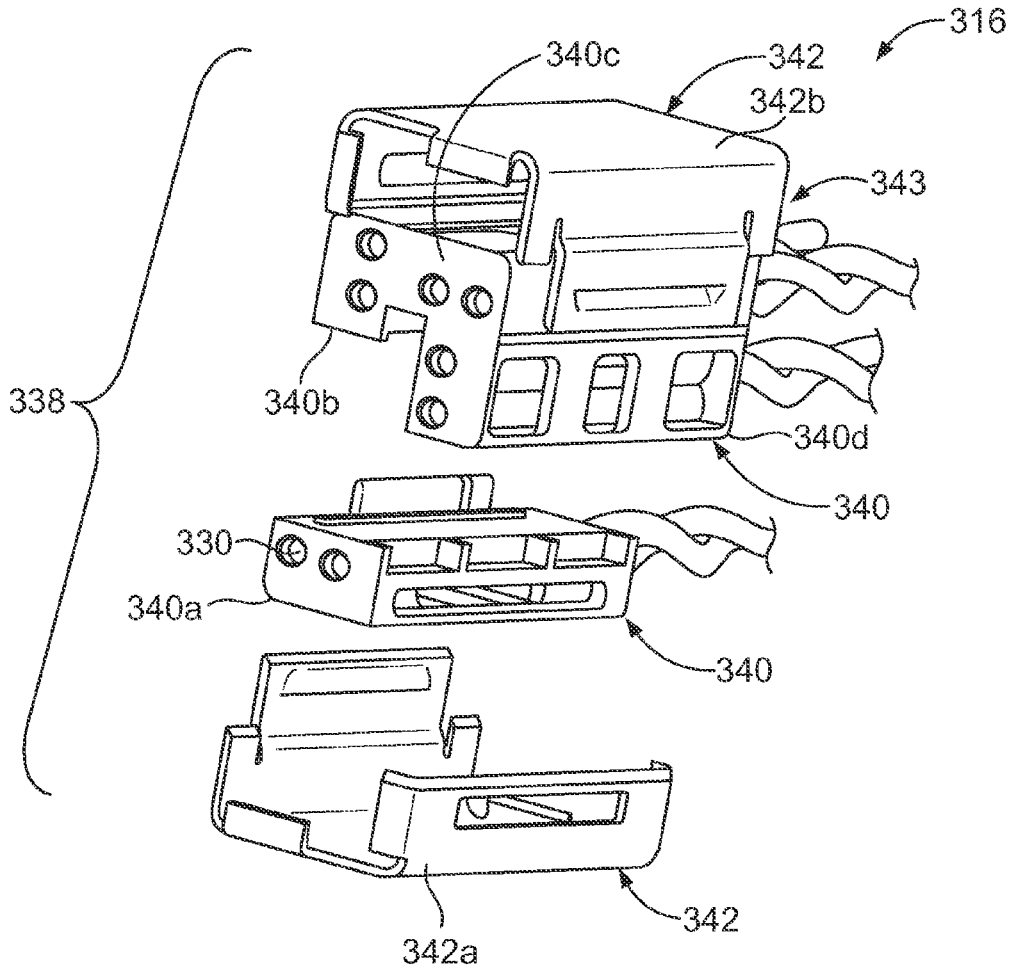
FIG. 6 is a partially exploded perspective view of an exemplary alternative embodiment of a signal module.

FIG. 6 is a partially exploded perspective view of an exemplary alternative embodiment of a signal module 316. The signal module 316 includes an insulator 340 and a shell 342. The insulator 340 is defined by a plurality of interlocking insulator sections 340*a*, 340*b*, 340*c*, and 340*d*. Each insulator section 340*a-d* holds one or more signal contacts 330. The insulator sections 340*a-d* interlock together using any suitable connection (such as, but not limited to, a press-fit connection, a snap-fit connection, and/or the like) to define the insulator 340. The shell 342 optionally includes two shell sections 342*a* and 342*b* that connect together to at least partially surround the insulator 340. The shell 342 may be referred to herein as an "electrically conductive shield".

Figure 7:
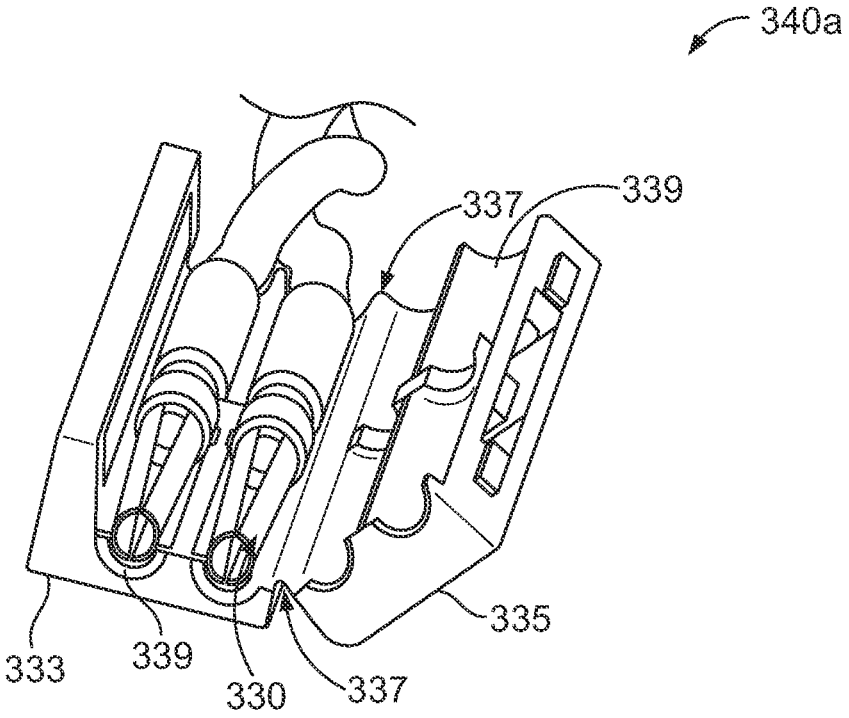
FIG. 7 is a perspective view of an exemplary embodiment of an insulator section of the signal module shown in FIG. 6.

Optionally, the insulator sections 340*a-d* are each defined by having two segments that are connected together at a hinge. For example, FIG. 7 is a perspective view of an exemplary embodiment of the insulator section 340*a*. The insulator section 340*a* is defined by the two segments 333 and 335 that are connected together at the hinge 337. The segments 333 and/or 335 optionally include one or more contact openings 339 for holding the corresponding signal contacts 330. The signal module 316 may enable a wire twist to be maintained up to a rear end 343 (FIG. 6) of the signal module 316. Although the insulator section 340*a* is defined by two segments 333 and 335, each of the insulator sections 340*a-d* may be defined by any number of segments. Moreover, each segment of each insulator section 340*a-d* may include any number of contact openings 339 for holding any number of the signal contacts 330. The insulator sections 340*b-d* are substantially similar to the insulator section 340*a* and thus the hinged segments of the insulator sections 340*b-d* will not be described in more detail herein.

Figure 8:
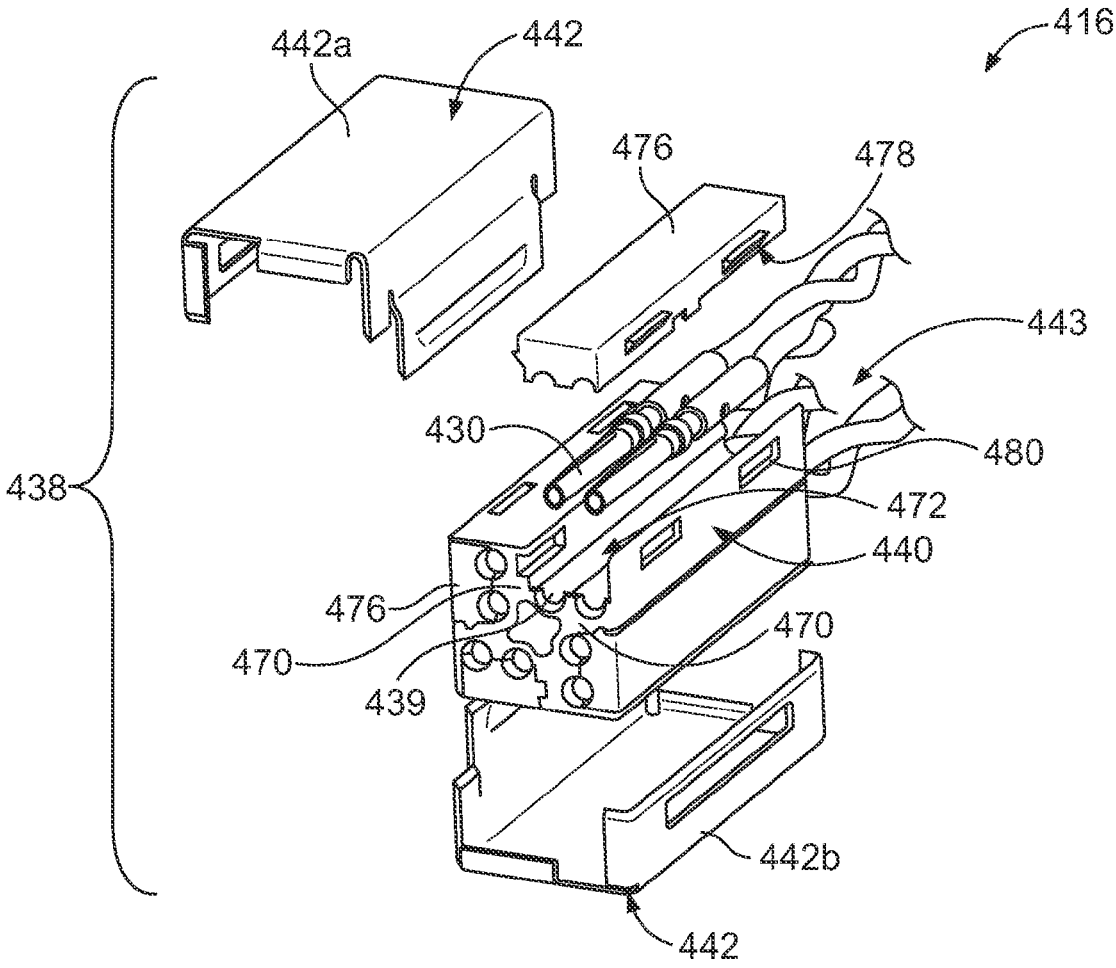
FIG. 8 is a partially exploded perspective view of another exemplary alternative embodiment of a signal module.

FIG. 8 is a partially exploded perspective view of another exemplary alternative embodiment of a signal module 416. The signal module 416 includes an insulator 440 and an optional shell 442. The insulator 440 includes one or more partitions 470 that define one or more compartments 472 for holding one or more signal contacts 430. Optionally, the compartments 472 include one or more contact openings 439 for receiving the signal contacts 430. The shell 442 optionally includes two shell sections 442*a* and 442*b* that connect together to surround the insulator 440. The signal module 416 may enable a wire twist to be maintained up to a rear end 443 of the signal module 416. The shell 442 may be referred to herein as an "electrically conductive shield".

Lids 476 are mounted on the insulator 440 over the compartments 472 such that the lids 476 interlock with the insulator 440. The lids 476 hold the signal contacts 430 within the compartments 472. In the exemplary embodiment, the lids 476 are mounted on the insulator 440 using a snap-fit connection. More specifically, the snap-fit connection between the lids 476 and the insulator 440 is provided by one or more resiliently deflectable latch tabs 478 on the lids 476 that cooperate with notches 480 that extend within the insulator 440. In addition or alternatively to the exemplary embodiment of the snap-fit connection described above, the snap-fit connection between the lids 476 and the insulator 440 may be provided by any other structure, means, and/or the like. Moreover, in addition or alternatively to the snap-fit connection, the lids 474 may be mounted on the insulator 440 using any other type of connection, such as, but not limited to, a press-fit connection, using a latch, using a clip, using a threaded fastener, using a non-threaded fastener, and/or the like.

The insulator 440 may include any number of the partitions 470 for defining any number of compartments 472. Moreover, each compartment 472 may include any number of contact openings 439 for holding any number of the signal contacts 430.

Figure 9:
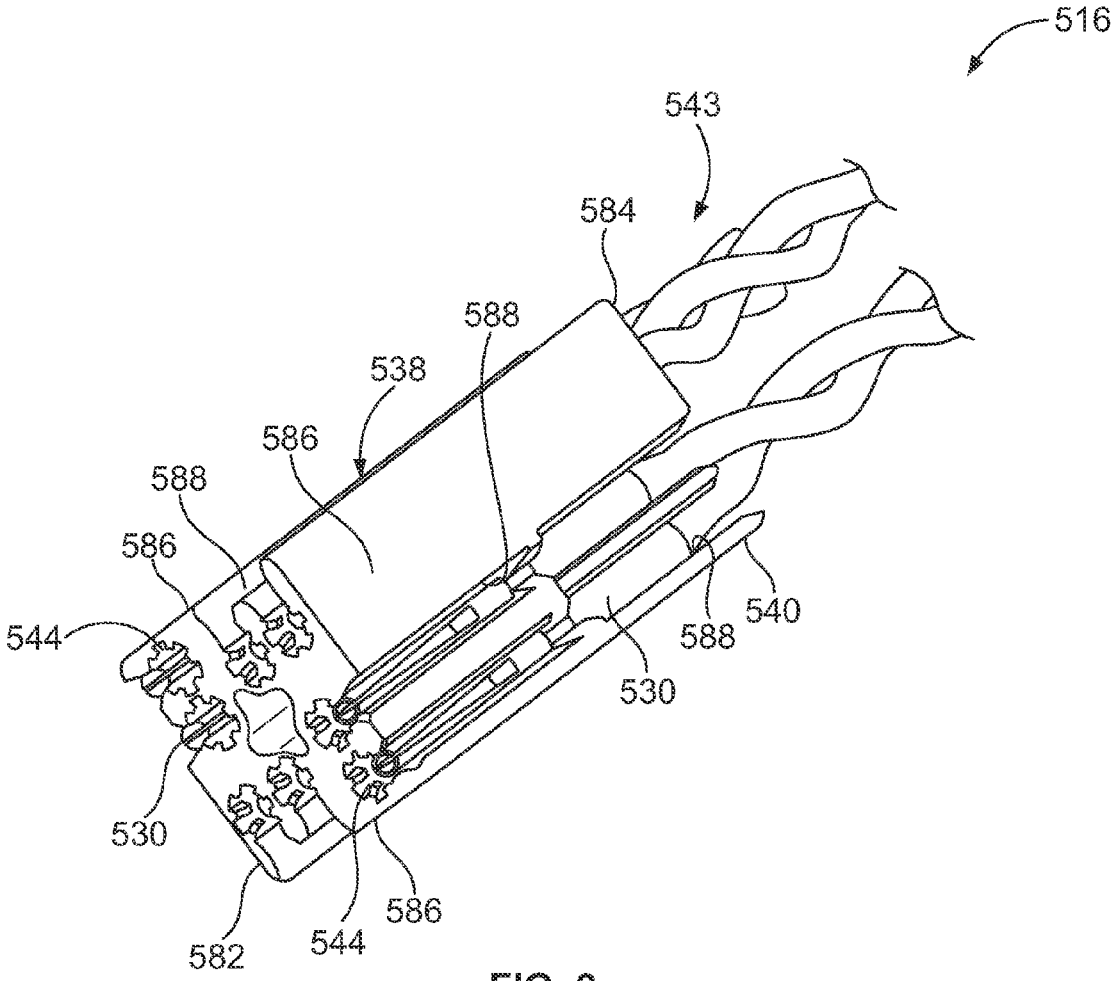
FIG. 9 is a perspective view of another exemplary alternative embodiment of a signal module.

FIG. 9 is a perspective view of another exemplary alternative embodiment of a signal module 516. The signal module 516 includes an insulator 540. Optionally, the signal module 516 includes a shell (not shown) that extends at least partially around the insulator 540. The insulator 540 includes a front face 582, a rear face 584, and one or more side walls 586 that extend from the front face 582 to the rear face 584. A rear end 543 of the insulator 540 includes the rear face 584. One or more contact openings 544 extend into the insulator 540 for holding one or more signal contacts 530. In the exemplary embodiment, the signal contacts 530 are held by the insulator 540 by being press-fit within the contact openings 544. But, the signal contacts 530 may be additionally or alternatively held by the insulator 540 using any other suitable method, structure, means, configuration, connection type, and/or the like, such as, but not limited to, using a snap-fit connection, a latch, a fastener, and/or the like.

Each side wall 586 includes one or more openings 588 that extends through the side wall 586 into a corresponding contact opening 544. The openings 588 enable the signal contacts 530 to be loaded into the insulator 540 through the side wall 586. More specifically, the openings 588 enable the signal contacts 530 to be loaded into the corresponding contact opening 544 through the corresponding side wall 586. The signal module 516 may enable a wire twist to be maintained up to the rear end 543 of the signal module 516. The insulator 540 may include any number of the contact openings 544 for holding any number of the signal contacts 530.

Figure 10:
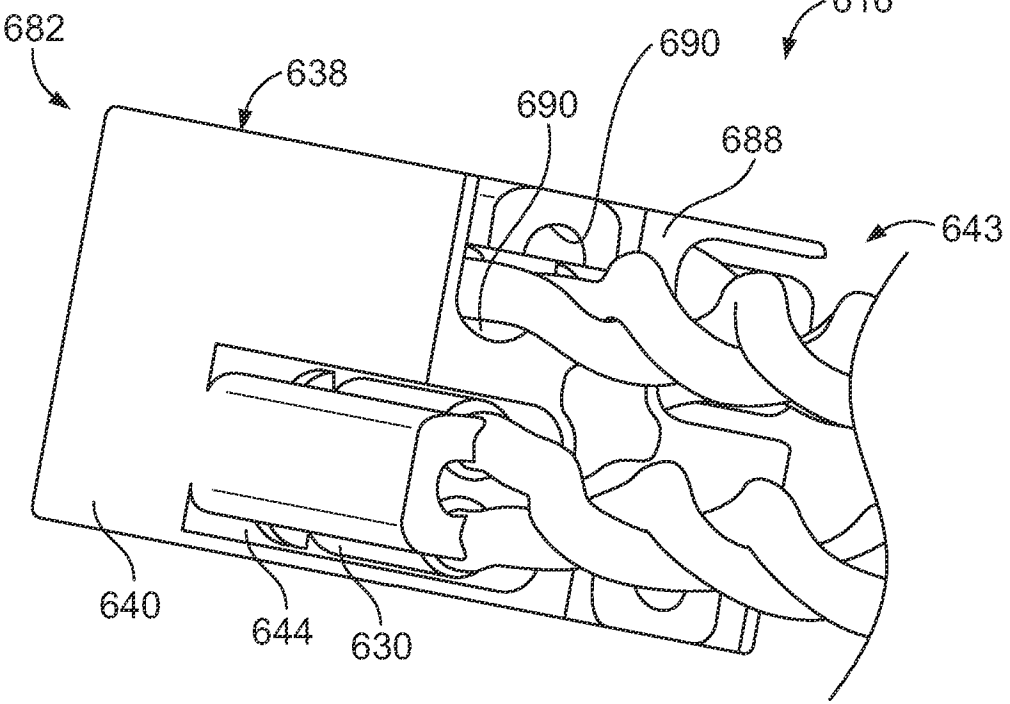
FIG. 10 is a perspective view of yet another exemplary alternative embodiment of a signal module.

FIG. 10 is a perspective view of yet another exemplary alternative embodiment of a signal module 616. The signal module 616 includes an insulator 640. Optionally, the signal module 616 includes a shell (not shown) that extends at least partially around the insulator 640. The insulator 640 extends from a mating end 682 to a rear end 643. One or more contact openings 644 extend into the insulator 640 for holding one or more signal contacts 630. In the exemplary embodiment, the signal contacts 630 are held by the insulator 640 by being press-fit within the contact openings 644. But, the signal contacts 630 may be additionally or alternatively held by the insulator 640 using any other suitable method, structure, means, configuration, connection type, and/or the like, such as, but not limited to, using a snap-fit connection, a latch, a fastener, and/or the like.

The rear end 643 of the insulator 640 includes a rear wall 688 that is split. More specifically, the rear wall 688 is split by a plurality of slots 690 that fluidly communicate with corresponding contact openings 644. The slots 690 enable the signal contacts 630 to be loaded into the insulator 640 through the rear end 643, and more specifically through the rear wall 688. The signal module 616 may enable a wire twist to be maintained up to the rear end 643 of the signal module 616. The insulator 640 may include any number of the contact openings 644 for holding any number of the signal contacts 630. The wall 688 may be referred to as a "split wall".

Figure 11:
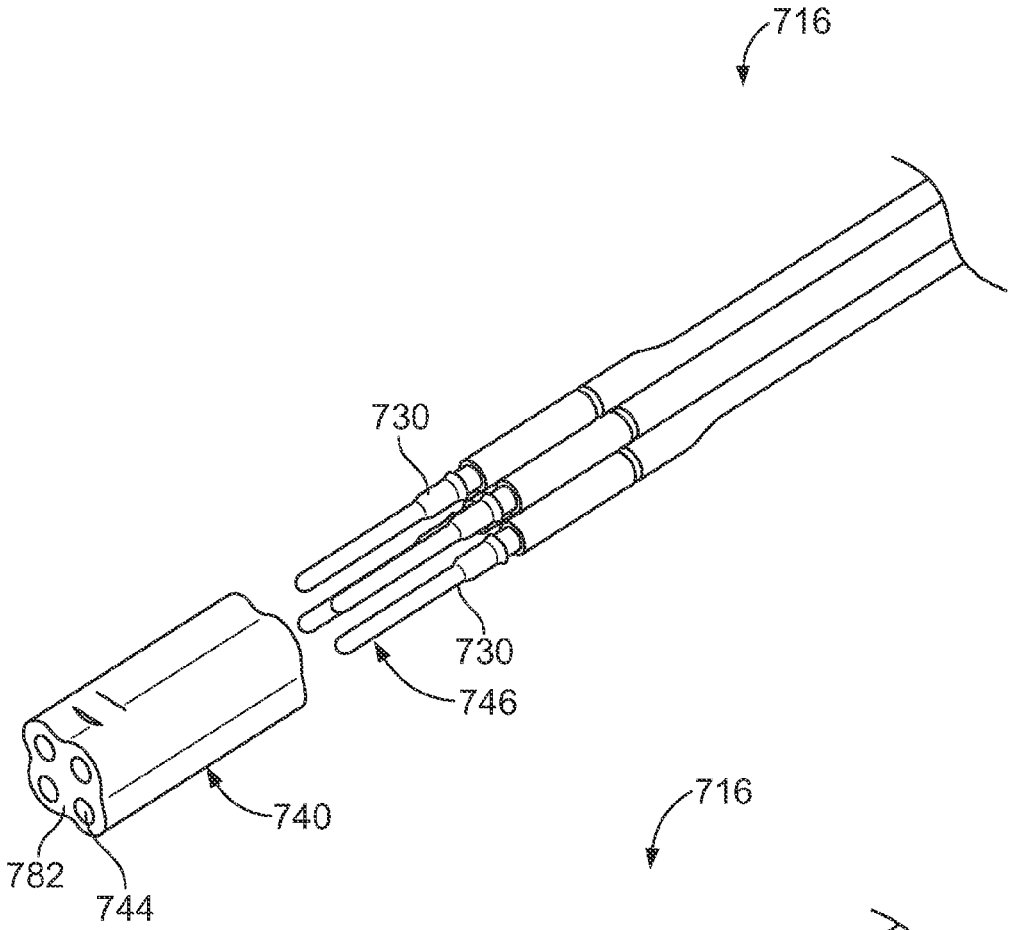
FIG. 11 is a partially exploded perspective view of still another exemplary alternative embodiment of a signal module.

FIG. 11 is a partially exploded perspective view of still another exemplary alternative embodiment of a signal module 716. The signal module 716 includes an insulator 740 that includes one or more contact openings 744 for receiving one or more signal contacts 730. The insulator 740 includes a front face 782. In the exemplary embodiment, the signal contacts 730 are held by the insulator 740 by being press-fit within the contact openings 744. But, the signal contacts 730 may be additionally or alternatively held by the insulator 740 using any other suitable method, structure, means, configuration, connection type, and/or the like, such as, but not limited to, using a snap-fit connection, a latch, a fastener, and/or the like.

Figure 12:
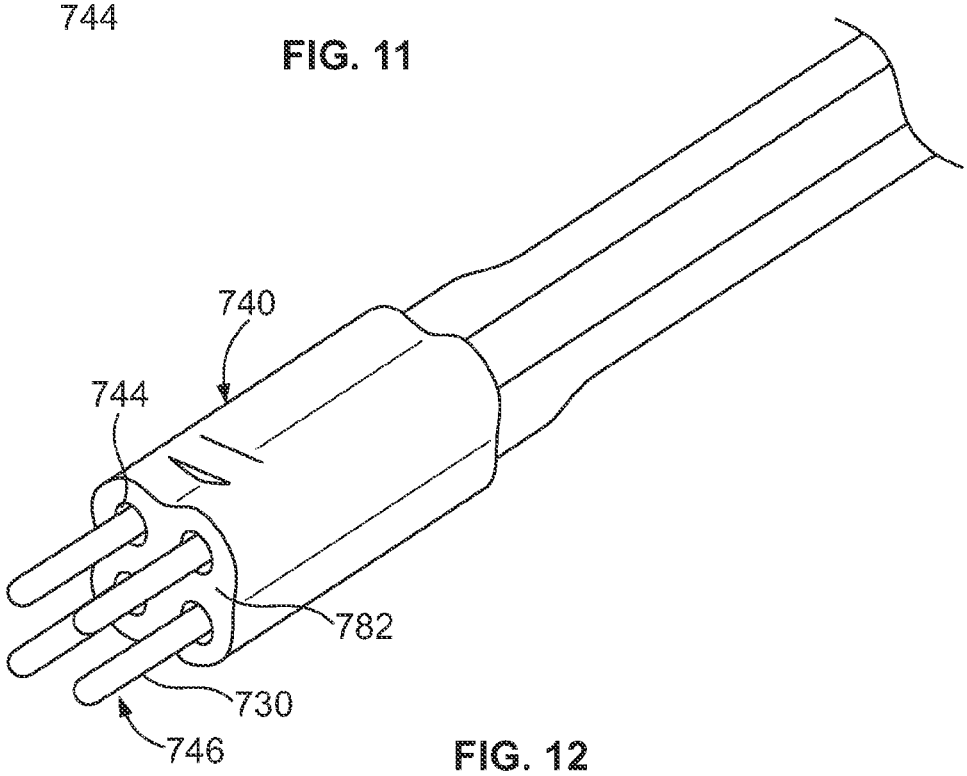
FIG. 12 is a perspective view of the signal module shown in FIG. 11 illustrating the signal module as assembled.

FIG. 12 is a perspective view of the signal module 716 illustrating the signal module 716 as assembled. In the exemplary embodiment, the mating ends 746 of the signal contacts 730 extend outwardly from the front face 782 of the insulator 740. In alternative embodiments wherein one or more of the signal contacts 730 includes a receptacle instead of the exemplary pin, the mating ends 746 of one or more of the signal contacts 730 optionally does not extend past the front face 782. The insulator 740 may include any number of the contact openings 744. Moreover, the signal module 716 may include any number of the signal contacts 730.

Figure 13:
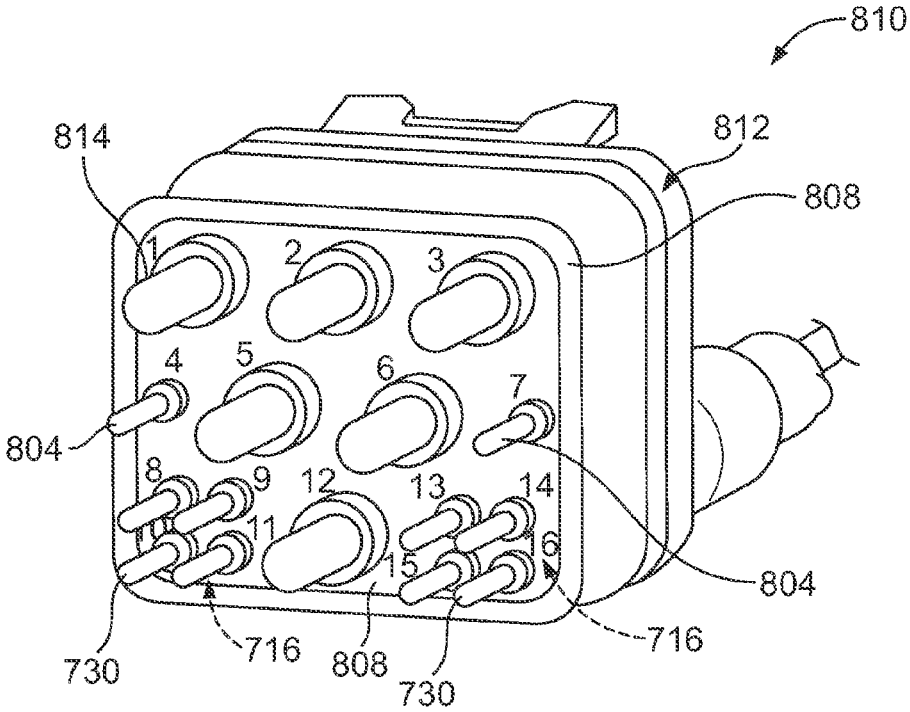
FIG. 13 is a perspective view of another exemplary alternative embodiment of an electrical connector.

FIG. 13 is a perspective view of another exemplary alternative embodiment of an electrical connector 810. The connector 810 includes a connector housing 812, six power contacts 814 held by the connector housing 812, two optional interchangeable signal modules 716 configured to be separably mounted to the connector housing 812, and optional signal contacts 804. The connector housing 812 includes two optional interchange ports (not shown) that receive the signal modules 716 therein. The connector 810 optionally includes an interfacial seal 808 that seals the interface between the connector 810 and the mating connector or electrical component with which the connector 810 mates.

The signal modules 716 include the signal contacts 730. Optionally, each of the signal modules 716 is configured to conduct electrical data signals at a rate of 1 GbE. The signal contacts 730 are optionally size 24 signal contacts. Although each signal module 716 includes four signal contacts 730, each signal module 716 may include any number of signal contacts 730. Optionally, the power contacts 814 are size 16 power contacts. The optional signal contacts 804 are held by the connector housing 812. The signal contacts 804 are optionally size 22 contacts. Although two are shown, the connector 810 may include any number of the signal contacts 804.

As described above, the signal modules 716 and the interchange ports are optional. In embodiments wherein the connector 810 does not include any signal modules 716 and interchange ports, the signal contacts 730 are held by the connector housing 812, for example within contact openings (not shown) of the connector housing 812.

Figure 14:
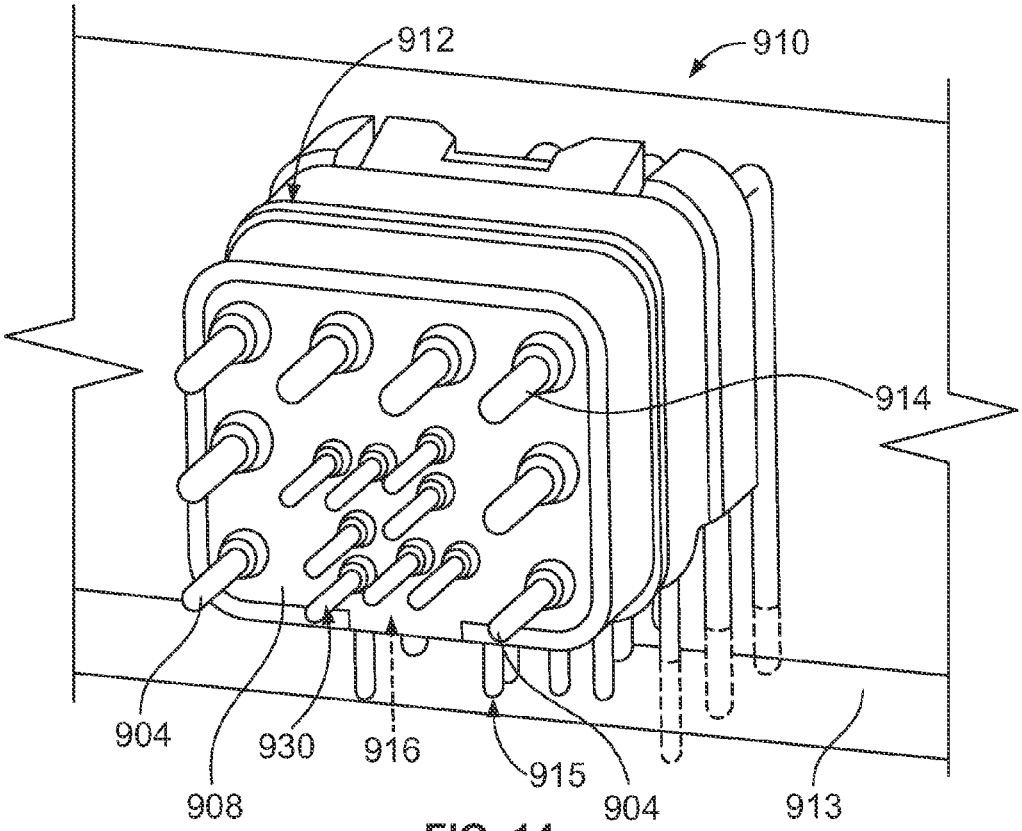
FIG. 14 is a front elevational view of an another exemplary alternative embodiment of an electrical connector.

FIG. 14 is a front elevational view of another exemplary alternative embodiment of an electrical connector 910. The connector 910 includes a connector housing 912, six power contacts 914 held by the connector housing 912, an optional interchangeable signal module 916 configured to be separably mounted to the connector housing 912, and optional signal contacts 904. The connector housing 912 includes an optional interchange port (not shown) that receives the signal module 916 therein. The location of the interchange port of the connector housing 912 may be selected to accommodate a desired pattern of the power contacts 914 along the connector housing 912, to facilitate mounting the connector 910 on a PCB 913, and/or to facilitate terminating the connector 910 to the end of a cable. In the exemplary embodiment, the connector 910 is configured to be mounted on the PCB 913 and the location of the interchange port is configured to minimize the length of mounting ends 915 and/or other segments of the signal contacts 930. The connector 910 optionally includes an interfacial seal 908 that seals the interface between the connector 910 and the mating connector or electrical component with which the connector 910 mates.

The signal module 916 includes signal contacts 930. In the exemplary embodiment, the signal module 916 is a 10 GbE connector. Optionally, the signal contacts 930 are size 24 signal contacts. Although the signal module 916 includes eight signal contacts 930, the signal module 916 may include any number of signal contacts 930. In the exemplary embodiment, the power contacts 914 are size 20 power contacts. The optional signal contacts 904 are held by the connector housing 912. In the exemplary embodiment, the signal contacts 904 are size 22 contacts. Although two are shown, the connector 910 may include any number of the signal contacts 904.

As described above, the signal module 916 and the interchange port are optional. In embodiments wherein the connector 910 does not include the signal module 916 and interchange port, the signal contacts 930 are held by the connector housing 912, for example within contact openings (not shown) of the connector housing 912.

The embodiments described and/or illustrated herein may provide a signal module that is configured to conduct electrical data signals at least 1 GbE, at least 10 GbE, less than 10 GbE, greater than 10 GbE, and/or the like. The embodiments described and/or illustrated herein may provide an electrical system that is lighter and/or that includes fewer components than at least some known electrical systems. The modular nature of the signal modules described and/or illustrated herein may enable flexibility in the selection of materials, manufacturing methodologies, assembly techniques, wire configurations, optimized pin-out patterns, and/or the like of the connector and/or the components thereof (including the signal module(s) selected for use within the connector). Such flexibility may enable the connector to be completed with fewer components and/or at less cost. For example, the dielectric materials and/or design of the signal module can be optimized to maintain a predetermined impedance with enhanced signal integrity for varying high-speed configurations, such as, but not limited to, Quadrax cable, STP/UTP, parallel pairs, and/or the like. Manufacturing methodologies may be selected to reduce the number of components and/or the cost of the connector. Assembly techniques may be optimized to facilitate easy assembly in the field while achieving preferred wire placement for enhanced signal integrity performance. Shielding of the signal module may be provided to meet varying EMI/RFI shielding requirements and/or to provide additional protection from the power contacts. The modular nature of the signal modules described and/or illustrated herein may also allow for strategic location of pin-out patterns of the connector, which may maximize the space required for power and additional discrete data. Moreover, the location of the interchange port of the connector housing may be selected to facilitate mounting the connector on a PCB, to facilitate terminating the connector to the end of a cable, and/or to accommodate a pattern of the power contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description and the drawings. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing having at least one contact cavity and an interchange port;

a power contact held by the connector housing within the contact cavity, the power contact being configured to conduct electrical power; and an interchangeable signal module separably mounted to the connector housing such that at least a portion of the signal module is held within the interchange port of the connector housing, the signal module comprising an insulator holding a signal contact that is configured to conduct electrical data signals.

2. The electrical connector according to claim 1, wherein the signal module comprises an electrically conductive shield at least partially surrounding the signal contact.

3. The electrical connector according to claim 1, wherein the signal module comprises a shell that extends at least partially around the insulator, the insulator having a contact opening, the signal contact being held by the insulator such that at least a portion of the signal contact extends within the contact opening of the insulator.

4. The electrical connector according to claim 1, wherein the signal module is received within the interchange port of the connector housing with a snap-fit connection.

5. The electrical connector according to claim 1, further comprising an electrically conductive shield that is held by the connector housing proximate the interchange port, the electrically conductive shield at least partially surrounding the interchange port.

6. The electrical connector according to claim 1, wherein the electrical connector is configured to mate with a mating connector having an electrically conductive shield, the connector housing comprising a shield slot that one of:

extends into the connector housing and at least partially surrounds the interchange port; or is defined within the interchange port between the signal module and the connector housing.

7. The electrical connector according to claim 1, wherein the insulator comprises a plurality of interlocking insulator sections.

8. The electrical connector according to claim 1, wherein the insulator comprises segments that are connected together at a hinge.

9. The electrical connector according to claim 1, wherein the insulator has a compartment for holding the signal contact, the signal module further comprising a lid mounted over the compartment to hold the signal contact within the compartment.

10. The electrical connector according to claim 1, wherein the insulator extends from a mating end to a rear end, the rear end of the insulator comprising a split wall such that the signal contact can be loaded into the insulator through the rear end.

11. The electrical connector according to claim 1, wherein the insulator includes a front face, a rear face, and side walls that extend from the front face to the rear face, at least one of the side walls comprising an opening such that the signal contact can be loaded into the insulator through the at least one side wall.

12. The electrical connector according to claim 1, wherein the signal module is configured to conduct electrical data signals at a rate of at least 10 Gigabit Ethernet (GbE).

13. The electrical connector according to claim 1, wherein the signal module comprises a resiliently deflectable latch arm that cooperates with the connector housing such that the signal module is received within the interchange port of the connector housing with a snap-fit connection.

14. An electrical connector assembly comprising:

a pin connector comprising a pin connector housing, a power pin contact held by the pin connector housing, and a signal pin contact, the power pin contact being configured to conduct electrical power, the signal pin contact being configured to conduct electrical data signals, wherein the pin connector comprises a first interchange port extending within the pin connector housing and an interchangeable first signal module separably mounted to the pin connector housing such that at least a portion of the first signal module is held within the first interchange port, the first signal module comprising a first insulator that holds the signal pin contact; and a socket connector configured to mate with the pin connector, the socket connector comprising a socket connector housing, a power socket contact held by the socket connector housing, and a signal socket contact, the power socket contact being configured to conduct electrical power, the signal socket contact being configured to conduct electrical data signals, wherein the socket connector comprises a second interchange port extending within the socket connector housing and an interchangeable second signal module separably mounted to the socket connector housing such that at least a portion of the second signal module is held within the second interchange port, the second signal module comprising a second insulator that holds the signal socket contact.

15. The electrical connector assembly according to claim 14, wherein at least one of the first or the second signal module comprises an electrically conductive shield at least partially surrounding the corresponding signal pin contact or signal socket contact.

16. The electrical connector assembly according to claim 14, wherein at least one of the first or second signal module comprises a shell that extends at least partially around the corresponding first or second insulator, at least one of the first or second insulator having a contact opening, the corresponding signal pin contact or signal socket contact being held by the first or second insulator, respectively, such that at least a portion of the corresponding signal pin contact or signal socket contact extends within the contact opening of the corresponding first or second insulator.

17. The electrical connector assembly according to claim 14, wherein one of the pin connector or the socket connector comprises an electrically conductive shield, the other of the pin connector or socket connector comprising a shield slot that receives the shield therein when the pin and socket connectors are mated together.

18. The electrical connector assembly according to claim 14, wherein at least one of the first or second signal modules is received within the corresponding first or second interchange port with a snap-fit connection.

19. The electrical connector assembly according to claim 4, wherein at least one of the first or second signal module is configured to conduct electrical data signals at a rate of at least 1 Gigabit Ethernet (GbE).

20. The electrical connector assembly according to claim 14, wherein at least one of the first or second signal modules comprises a resiliently deflectable latch arm that cooperates with the corresponding pin or socket connector housing such that at least one of the first or second signal modules is received within the corresponding first or second interchange port with a snap-fit connection.

21. The electrical connector according to claim 1, wherein the signal module comprises a shell that forms a shroud that extends around a mating end of the signal contact.

22. The electrical connector according to claim 1, wherein the signal module comprises a shell that forms a shroud that extends only partially around a mating end of the signal contact.

* * * * *